US007748240B1

(12) United States Patent
Cherneski

(10) Patent No.: US 7,748,240 B1
(45) Date of Patent: Jul. 6, 2010

(54) FOOT GRIPPING GARMENT

(76) Inventor: James Paul Cherneski, 709 Lelia Ct., Bel Air, MD (US) 21014

( * ) Notice: Subject to any disclaimer, the term of this patent is extended or adjusted under 35 U.S.C. 154(b) by 0 days.

(21) Appl. No.: 12/397,359

(22) Filed: Mar. 4, 2009

(51) Int. Cl.
*A41B 11/00* (2006.01)

(52) U.S. Cl. ..... 66/185; 2/239

(58) Field of Classification Search ..... 66/185–188; 2/239–241
See application file for complete search history.

(56) References Cited

U.S. PATENT DOCUMENTS

| | | | | |
|---|---|---|---|---|
| 2,050,535 | A * | 8/1936 | Martel | 66/178 R |
| 3,874,001 | A | 4/1975 | Patience et al. | |
| 3,983,870 | A | 10/1976 | Herbert et al. | |
| 4,021,860 | A * | 5/1977 | Swallow et al. | 2/239 |
| 4,069,515 | A | 1/1978 | Swallow et al. | |
| 4,069,600 | A | 1/1978 | Wise et al. | |
| 4,149,274 | A * | 4/1979 | Garrou et al. | 2/239 |
| 4,397,161 | A | 8/1983 | Chesebro, Jr. et al. | |
| 5,412,957 | A * | 5/1995 | Bradberry et al. | 66/178 A |
| 5,617,585 | A | 4/1997 | Fons et al. | |
| 5,737,943 | A | 4/1998 | Bernhardt | |
| 6,173,589 | B1 | 1/2001 | Hayes, Jr. et al. | |
| 6,324,874 | B2 * | 12/2001 | Fujimoto | 66/185 |
| 7,587,915 | B2 * | 9/2009 | Kaneda | 66/185 |
| 2003/0177566 | A1 | 9/2003 | Williams | |
| 2003/0230121 | A1 | 12/2003 | Yokoyama | |
| 2004/0221371 | A1 | 11/2004 | Kato | |
| 2006/0195972 | A1 | 9/2006 | Alley | |
| 2006/0253961 | A1 | 11/2006 | Chan | |
| 2007/0028365 | A1 | 2/2007 | Williams | |

* cited by examiner

*Primary Examiner*—Danny Worrell
(74) *Attorney, Agent, or Firm*—Ash Tankha

(57) ABSTRACT

Disclosed herein is a hosiery garment for providing grip to a person's foot between the foot and the hosiery garment, and for simultaneously providing grip to the person's foot between the hosiery garment and the inside of a footwear. The hosiery garment comprises a foot enclosure configured to conform to the person's foot. The foot enclosure defines an inner surface and an outer surface. A first pair comprising a first tacky thread and a first supplementary thread defines the inner surface. A second pair comprising a second tacky thread and a second supplementary thread defines the outer surface. The inner surface defined by the first pair provides grip to the person's foot between the foot and the hosiery garment, and the outer surface defined by the second pair simultaneously provides grip to the person's foot between the hosiery garment and the inside of the footwear.

9 Claims, 10 Drawing Sheets

FOOT GRIPPING GARMENT

BACKGROUND

This invention, in general, relates to hosiery garments. More particularly, this invention relates to a sock for providing grip to the foot of a person when the person is engaged in a sports or other activity.

In sports that involve running, skating, etc. where the person engaged in the sports activity changes directions quickly, the person's foot tends to slip inside the sock and also the sock tends to slip inside the shoe due to lack of sufficient grip between the feet and the sock and between the foot and the shoe respectively. This slippage also causes a lack of response time when the person moves in the new direction. Lack of sufficient grip may also cause the person playing the sport to slip or roll inside their shoe and suffer injuries. For example, the foot of the person wearing the sock and shoe may slip at the base of the shoe during a sharp turn leading to an ankle injury.

A conventional sock is typically constructed by knitting natural or synthetic yarns or both, utilizing circular knitting machines. The yarn is wrapped or packaged on cones or spools by machinery and then shipped to knitting mills for production of the conventional sock. The yarn cones hang from racks overtop the circular knitting machines. The yarn is then fed through finger tubes and moved through a series of latch needles that knits the yarn together. The upper section of the conventional sock is completed as a circular opening. The opening at the bottom of the sock is completed to form a toe seam. The foot of the person wearing the shoe may slip within the conventional sock worn and may result in the foot moving inside the shoe and may also lead to injuries. Athletes, in various sports that require sharp turns of direction, purchase extremely tight shoes to avoid slipping. However, this does not provide a total solution and is also rather uncomfortable and unhealthy for the athletes' feet. The conventional sock thus constructed using yarn may not provide sufficient grip to the person's foot.

Hence there is an unmet need for a hosiery garment that provides grip to the person's foot and prevents the person's foot from slipping inside the hosiery garment and also prevents the hosiery garment from slipping inside the shoe.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

The hosiery garment disclosed herein prevents the foot from slipping inside the hosiery garment and also prevents the hosiery garment from slipping inside a footwear by adhering to the skin on the foot and the inside material of the footwear respectively by the use of a first tacky thread knit on an inner surface of a foot enclosure and a second tacky thread knit to an outer surface of the foot enclosure using a plating technique where a circular knitting machine knits one thread of a material or more than one threads of different materials to the inner surface of the foot enclosure, and one thread of a material or more than one threads of different materials to the outer surface of the foot enclosure.

The first tacky thread is exposed on the inner surface but not the outer surface of the foot enclosure. The second tacky thread is exposed on the outer surface but not the inner surface of the foot enclosure.

Figure 1:
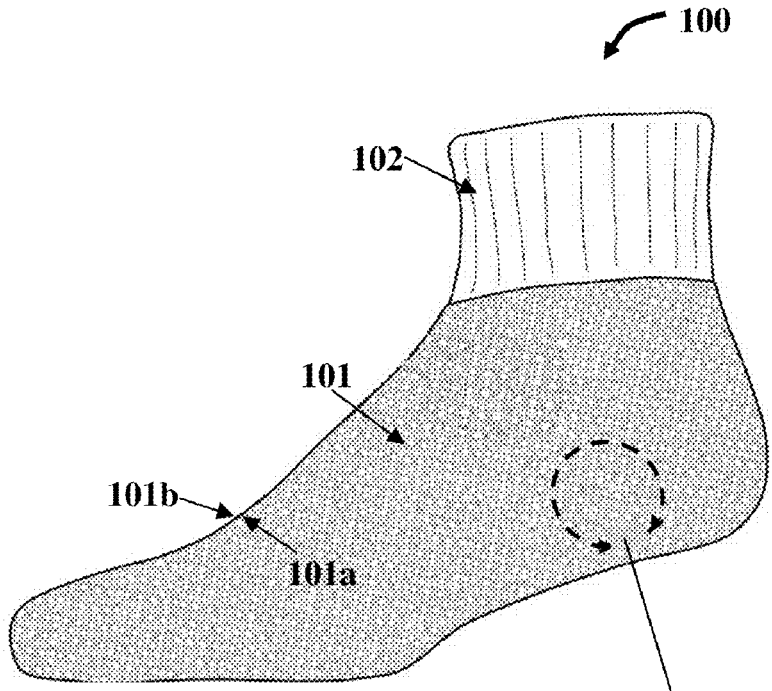
FIG. 1 illustrates a hosiery garment for providing grip to a foot of a person between the foot and the hosiery garment, and for simultaneously providing grip to the foot of the person between the hosiery garment and the inside of a footwear.

FIG. 1 illustrates a hosiery garment 100 for providing grip to a foot of a person between the foot and the hosiery garment 100, and for simultaneously providing grip to the foot of the person between the hosiery garment 100 and the inside of a footwear. The footwear is, for example, shoes such as soccer shoes, football shoes, basketball shoes, tennis shoes, skate boots, ski boots, etc. The hosiery garment 100 comprises a foot enclosure 101. The hosiery garment 100 is a fabric made of a traction, tacky yarn herein referred to as a first tacky thread 201*a* and a second tacky thread 202*a*, knitted with yarns made of a traditional material herein referred to as supplementary threads 201*b* and 202*b*. The first tacky thread 201*a* and the second tacky thread 202*a* are made of the same material. In an embodiment, the first tacky thread 201*a* and the second tacky thread 202*a* are made of different traction, tacky materials. The first tacky thread 201*a* and the second tacky thread 202*a* may, for example, be made, of a synthetic material such as a synthetic rubber, or a natural material such as latex also known as a natural rubber. In an embodiment, the tacky thread is an extruded vulcanized natural latex, gauge 68 and 75, made by the following company: Heveafil Sdn. Bdh., No. 1, Jalan Heveafil, 44300 Batang Kali, Ulu Selangor, Selangor Darul Ehsan, Malaysia.

The supplementary threads 201*b* and 202*b* may, for example, be made of materials such as cotton, nylon, Lycra®, acrylic, wool or other traditional materials used in the manufacture of socks. In an embodiment, the hosiery garment 100 may have a first type of supplementary thread 201*b* used for the inner surface 101*a* of the foot enclosure 101 and a second type of supplementary thread 202*b* used for the outer surface 101*b* of the foot enclosure 101. For example, the first supplementary thread 201*b* used to make the inner surface 101*a* of the foot enclosure 101, that accompanies the first tacky thread 201*a*, is made of cotton, while the second supplementary thread 202*b* used to make the outer surface 101*b* of the foot enclosure 101, that accompanies the second tacky thread 202*a* is, for example, made of nylon. In an embodiment, the supplementary threads 201*b* and 202*b* used for the inner surface 101*a* and the outer surface 101*b* are made of the same material.

Figure 3:
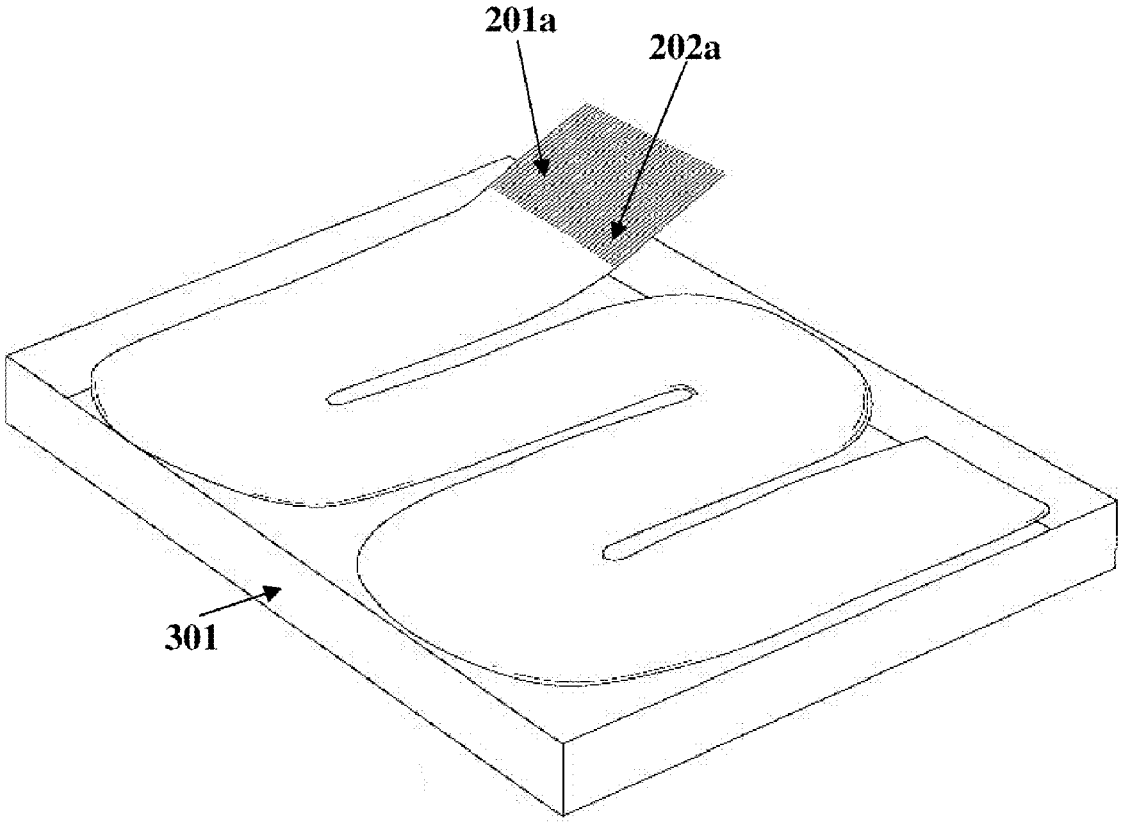
FIG. 3 exemplarily illustrates multiple tacky threads packed in a box received from a tacky thread manufacturer.

The first tacky thread 201*a* and the second tacky thread 202*a* are coated with an anti-adhesive material, for example, silicon, talcum powder, etc, to allow the free flow of the tacky threads 201*a* and 202*a* through the circular knitting machine 603. Also, the first tacky thread 201*a* and the second tacky thread 202*a* are not intertwined or covered with an additional fabric or supplementary thread. The first tacky thread 201*a* and the second tacky thread 202*a* may have a thickness ranging from about 1 millimeter diameter to about 0.3 millimeters diameter. The tacky threads 201*a* and 202*a* may be packed in a box 301 as exemplarily illustrated in FIG. 3 and sent to a twisting mill to be wound into spools 502*a* and 502*b*. The box 301, for example, contains approximately about 40 to 60 tacky threads 201*a* and 202*a* that are packaged side by side, to form a tape like appearance. The tacky threads 201*a* and 202*a*, for example, latex threads, in the box 301 are then separated into 40 to 60 tacky threads 201*a* and 202*a* and wound onto spools 502*a* and 502*b* or cones.

The foot enclosure 101 of the hosiery garment 100 is configured to conform to the person's foot. The foot enclosure 101 defines an inner surface 101*a* and an outer surface 101*b*. A stitch pattern, for example, plating, is used for creating the inner surface 101*a* and the outer surface 101*b* of the foot enclosure 101. The inner surface 101*a* is proximal to the person's foot and distal to the footwear when the person is wearing the foot enclosure 101 and the footwear. The outer surface 101*b* is distal to the person's foot and proximal to the footwear when the person is wearing the foot enclosure 101 and the footwear.

Figure 2:
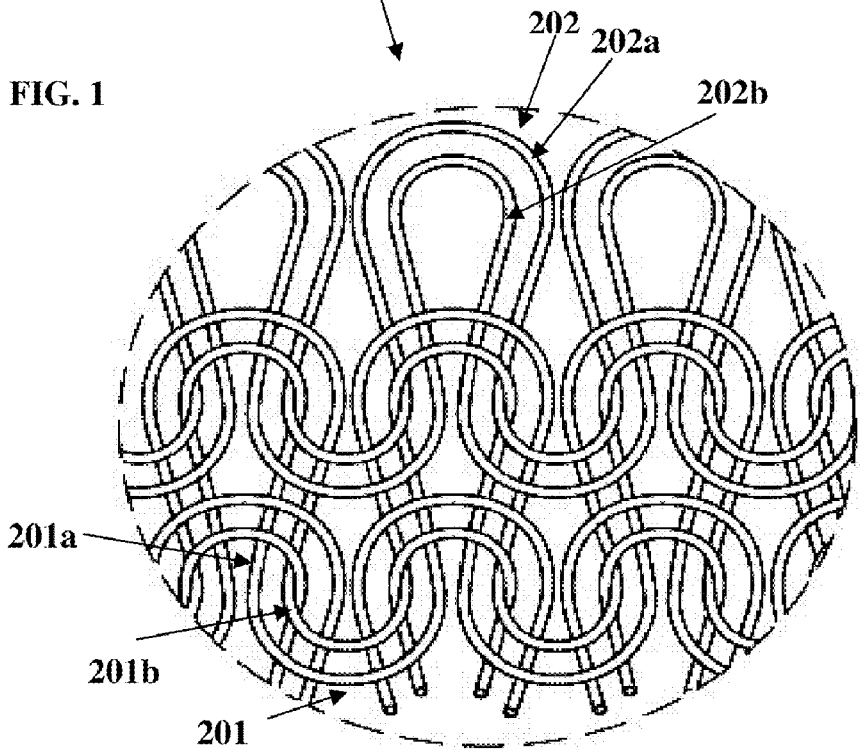
FIG. 2 illustrates a first pair comprising a first tacky thread and a first supplementary thread knitted with a second pair comprising a second tacky thread and a second supplementary thread, used in the construction of the hosiery garment.

A first pair 201 comprising the first tacky thread 201*a* and the first supplementary thread 201*b* defines the inner surface 101*a* of the foot enclosure 101. The first tacky thread 201*a* is exposed on the inner surface 101*a* of the foot enclosure 101. The first tacky thread 201*a* is not exposed on the outer surface 101*b* of the foot enclosure 101. A second pair 202 comprising the second tacky thread 202*a* and the second supplementary thread 202*b* defines the outer surface 101*b* of the foot enclosure 101. The second tacky thread 202*a* is exposed on the outer surface 101*b* of the foot enclosure 101. The second tacky thread 202*a* is not exposed on the inner surface 101*a* of the foot enclosure 101. The second pair 202 is knitted with the first pair 201 to define the foot enclosure 101. The first pair 201 comprising the first tacky thread 201*a* and the first supplementary thread 201*b* knitted with the second pair 202 comprising the second tacky thread 202*a* and the second supplementary thread 202*b* are illustrated in FIG. 2.

For purposes of illustration, the first pair 201 refers to threads 201*a* and 201*b* and a second pair 202 refers to threads 202*a* and 202*b*. However, the scope of the hosiery garment 100 disclosed herein is not limited to the first pair 201 and the second pair 202 but may be extended to include multiple pairs of multiple threads.

The inner surface 101*a* of the foot enclosure 101 defined by the first pair 201 provides grip to the person's foot between the foot and the hosiery garment 100, and the outer surface 101*b* of the foot enclosure 101 defined by the second pair 202 simultaneously provides grip to the person's foot between the hosiery garment 100 and the inside of the footwear. The first pair 201 of threads and the second pair 202 of threads are knitted into the hosiery garment 100 such that the inner surface 101*a* of the foot enclosure 101 and the outer surface 101*b* of the foot enclosure 101 are made of the same traction, tacky material-supplementary material thread. In an embodiment, different traction, tacky material-supplementary thread combinations are used. The upper section 102 of the hosiery garment 100 may comprise any traditional fabric and has an opening at the top similar to traditional socks. The upper section 102 may be of different lengths.

Figure 4:
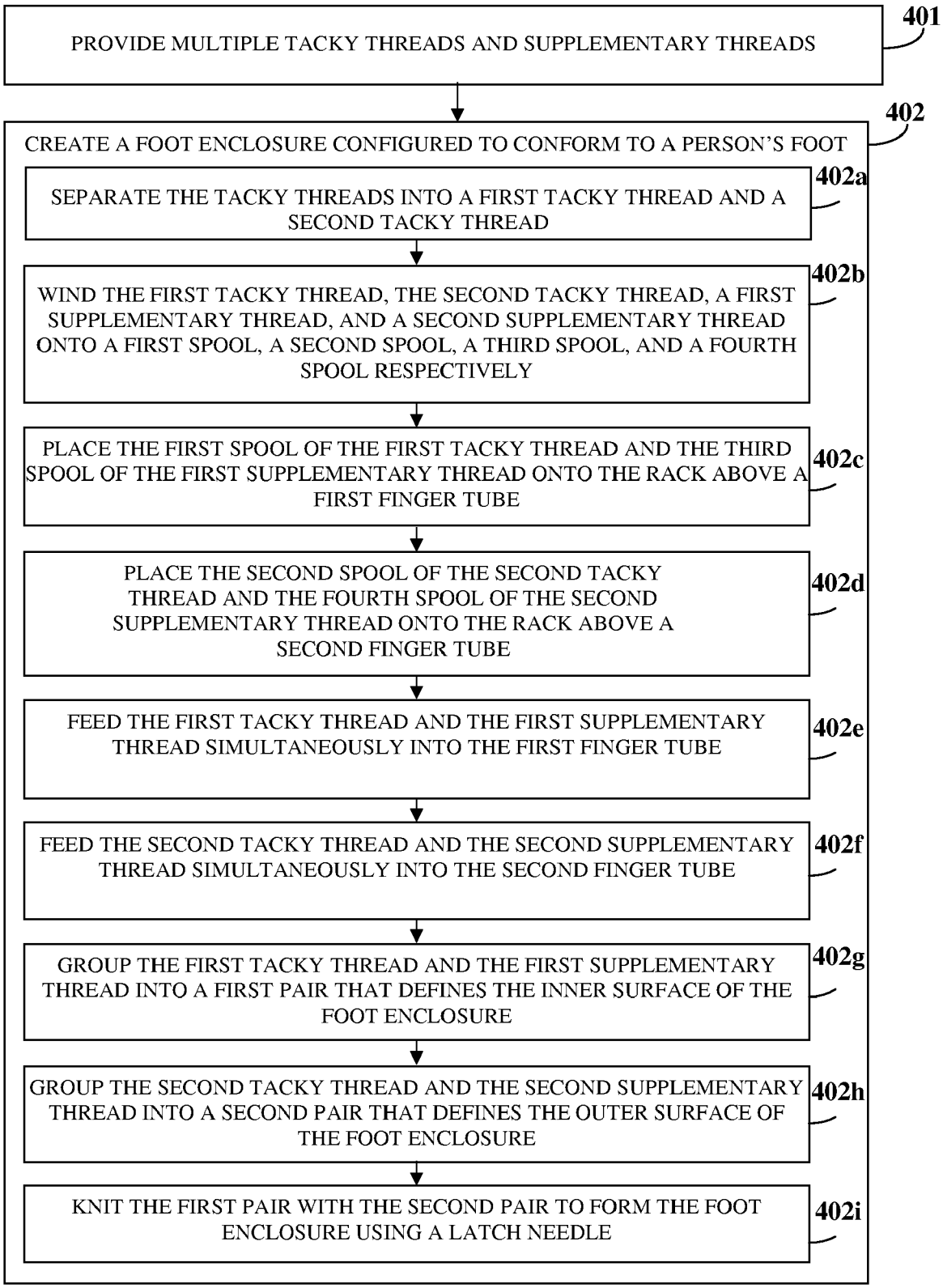
FIG. 4 illustrates a method of constructing a hosiery garment for providing grip to a foot of a person between the foot and the hosiery garment, and for simultaneously providing grip to the foot of the person between the hosiery garment and inside of a footwear.

FIG. 4 illustrates a method of constructing a hosiery garment 100 for providing grip to a foot of a person between the foot and the hosiery garment 100, and for simultaneously providing grip to the foot of the person between the hosiery garment 100 and inside of a footwear.

Figure 5:
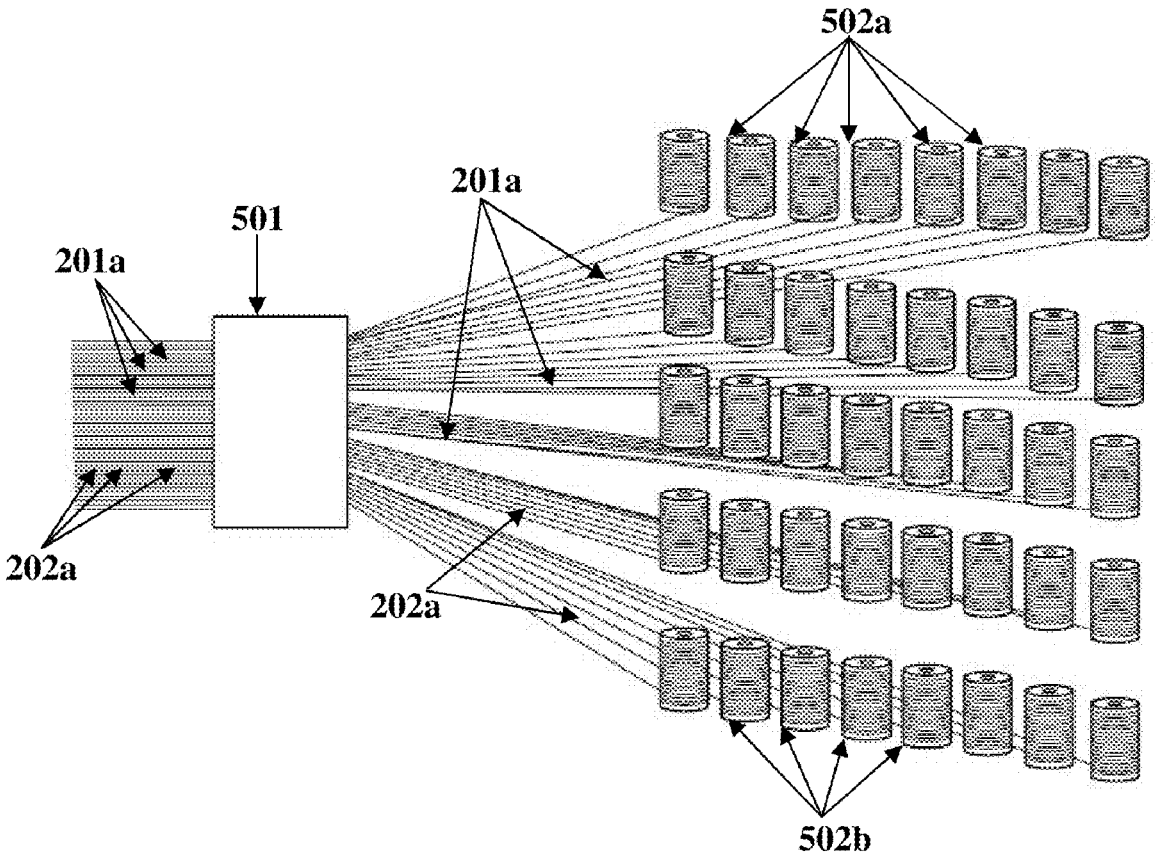
FIG. 5 exemplarily illustrates multiple tacky threads being separated and wound around spools.

Multiple tacky threads 201*a* and 202*a* and supplementary threads 201*b* and 202*b* are provided 401. The tacky threads 201*a* and 202*a* are coated with an anti-adhesive material, for example, silicon, talcum powder, etc. to prevent gathering and tangling in the machinery. A foot enclosure 101 configured to conform to the person's foot is created 402. To create the foot enclosure 101, the tacky threads 201*a* and 202*a* are separated out of the box 301 as exemplarily illustrated in FIG. 3. The tacky threads 201*a* and 202*a* are separated 402*a* into a first tacky thread 201*a* and a second tacky thread 202*a*. The box 301 of tacky threads 201*a* and 202*a* is shipped from the tacky thread supplier to a twisting mill. The tacky threads 201*a* and 202*a* in the box 301 may be wound into 40 different spools 502*a* and 502*b* or cones of tacky threads 201*a* and 202*a* in the twisting mill. FIG. 5 exemplarily illustrates multiple tacky threads 201*a* and 202*a* being separated and wound around spools 502*a* and 502*b*. The tacky threads 201*a* and 202*a* are then shipped to a hosiery mill for final production of the hosiery garment 100. An inner surface 101*a* using the first tacky thread 201*a* and the first supplementary thread 201*b*, and an outer surface 101*b* using the second tacky thread 202*a* and the second supplementary thread 202*b*, conforming to the person's foot are then created as follows:

Consider an example where the first tacky thread 201*a*, the second tacky thread 202*a*, a first supplementary thread 201*b*, and a second supplementary thread 202*b* are wound 402*b* onto a first spool 502*a*, a second spool 502*b*, a third spool 502*c*, and a fourth spool 502*d* respectively. The first spool 502*a* of the first tacky thread 201*a* and the third spool 502*c* of the first supplementary thread 201*b* are placed 402*c* onto a rack 604 positioned on a knitting unit 600 above a first finger tube 601*a* as exemplarily illustrated in FIGS. 6A-6B. The second spool 502*b* of the second tacky thread 202*a* and the fourth spool 502*d* of the second supplementary thread 202*b* are placed 402*d* onto the rack 604 positioned on the knitting unit 600 above a second finger tube 601*b* as exemplarily illustrated in FIGS. 6A-6B.

Figure 6A:
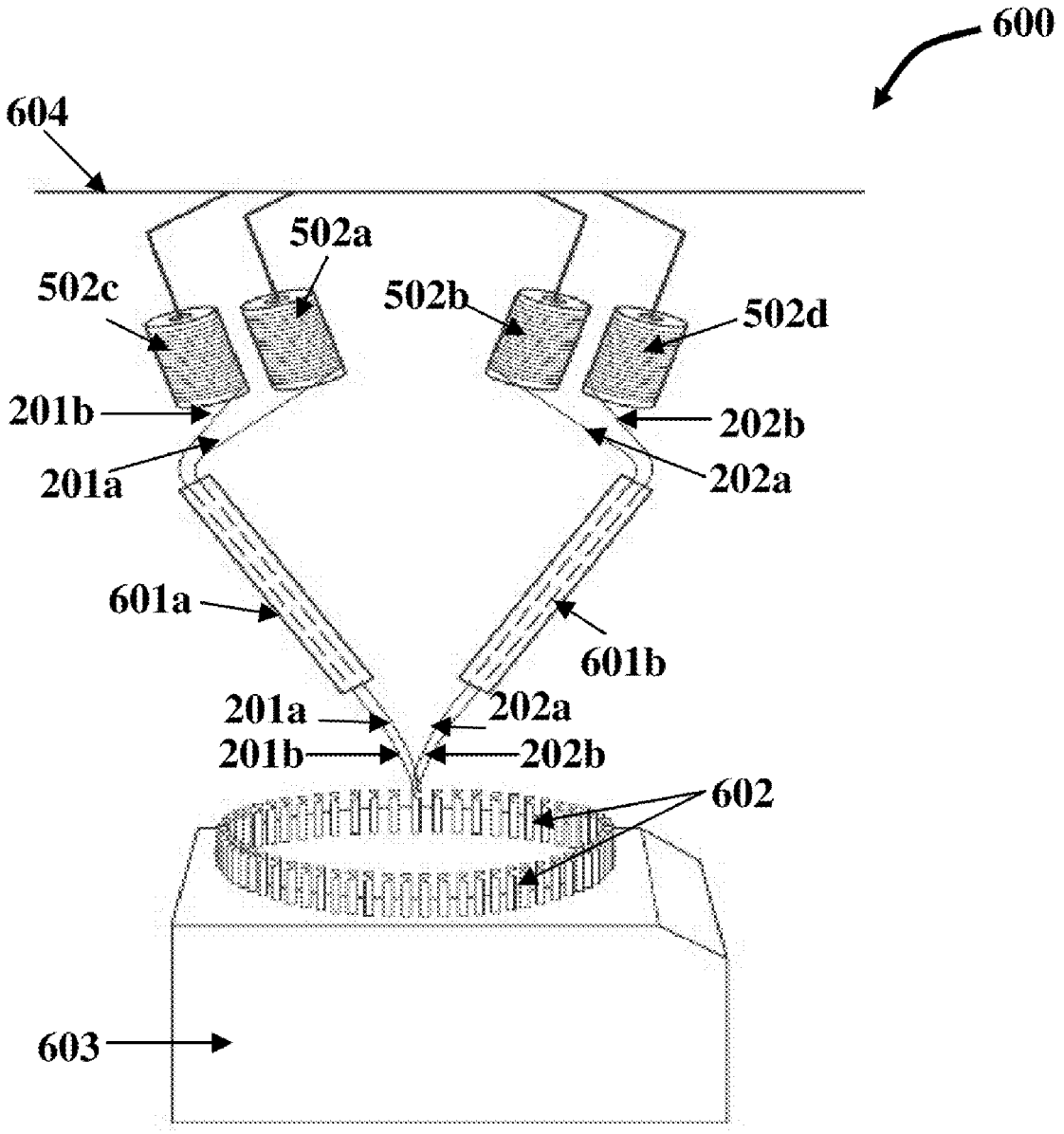
FIGS. 6A-6B exemplarily illustrate knitting of a first pair comprising a first tacky thread and a first supplementary thread with a second pair comprising a second tacky thread and a second supplementary thread.
Figure 6B:
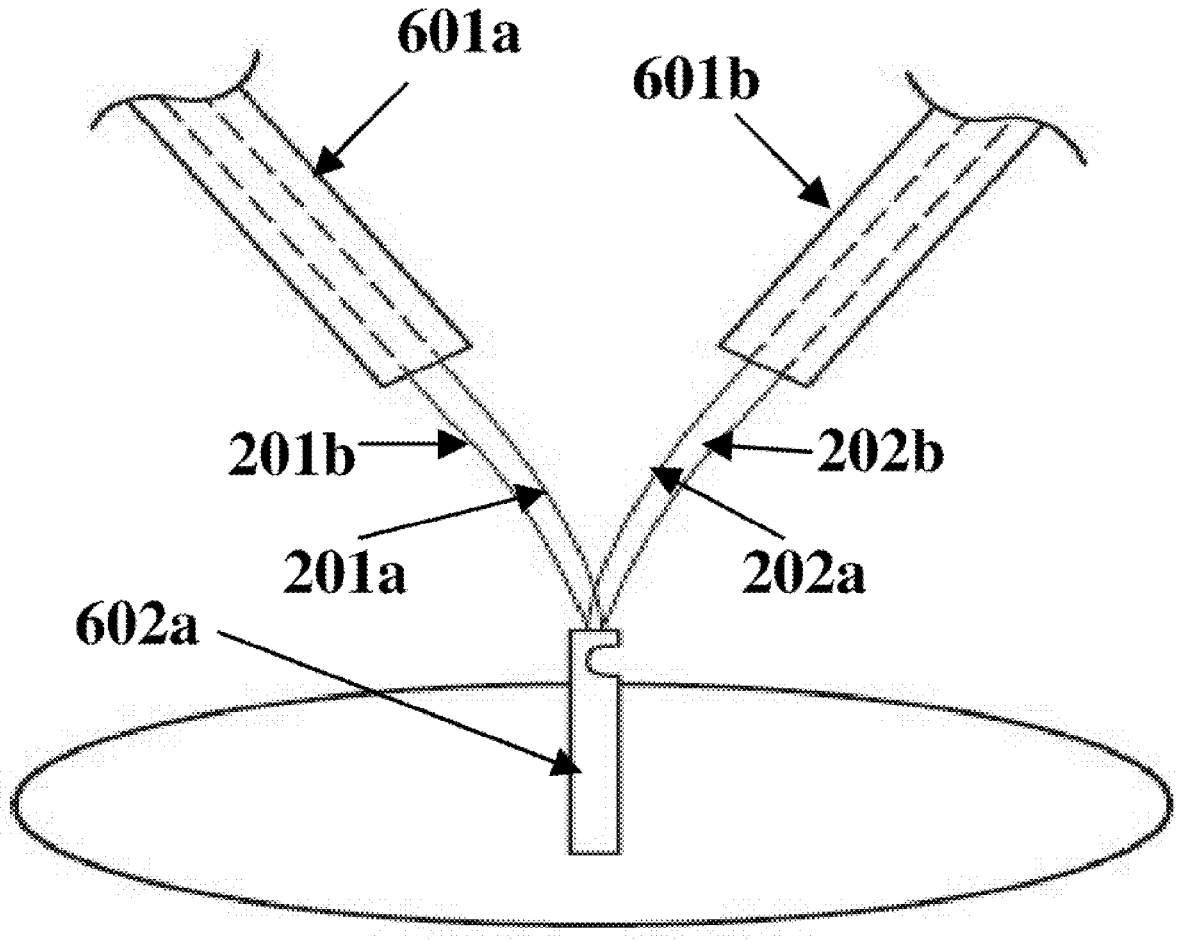

To create the inner surface 101*a*, the first tacky thread 201*a* and the first supplementary thread 201*b* from the first spool 502*a* and the third spool 502*c* respectively are simultaneously fed 402*e* into the first finger tube 601*a* as exemplarily illustrated in FIGS. 6A-6B. The first tacky thread 201*a* and the first supplementary thread 201*b* are grouped 402*g* into a first pair 201 that defines the inner surface 101*a* of the foot enclosure 101. The inner surface 101*a* forms a foot yarn.

To create the outer surface 101*b*, the second tacky thread 202*a* and the second supplementary thread 202*b* from the second spool 502*b* and the fourth spool 502*d* respectively are fed 402*f* simultaneously into the second finger tube 601*b* as exemplarily illustrated in FIGS. 6A-6B. The second tacky thread 202*a* and the second supplementary thread 202*b* are grouped 402*h* into a second pair 202 that defines the outer surface 101*b* of the foot enclosure 101.

The first pair 201 is knitted 402*i* with the second pair 202 to form the foot enclosure 101 using one or more of multiple latch needles 602 in the circular knitting machine 603 as illustrated in FIG. 6A. The circular knitting machine 603 is, for example, a Lonati 454 machine, Lonati Co., Brescia, Italy. The technique of knitting one or more pairs 201 of threads 201*a* and 201*b* to the inside of the foot enclosure 101 and one or more pairs 202 of the same or different material threads 202*a* and 202*b* to the outside of the foot enclosure 101 is known as plating. The first tacky thread 201*a* of the first pair 201 is exposed on the inner surface 101*a*. The first tacky thread 201*a* of the first pair 201 is not exposed on the outer surface 101*b*. The second tacky thread 202*a* of the second pair 202 is exposed on the outer surface 101*b*. The second tacky thread 202*a* of the second pair 202 is not exposed on the inner surface 101*a*.

A latch needle 602*a* accepts the first pair 201 of threads and the second pair 202 of threads at the same time to form the inner surface 101*a* and the outer surface 101*b* of the foot enclosure 101 simultaneously as illustrated in FIG. 6B. The gauge of the first tacky thread 201*a* and second tacky thread 202*a* may, for example, be in the range of about 1 millimeter diameter to about 0.3 millimeter diameter.

Figure 7:
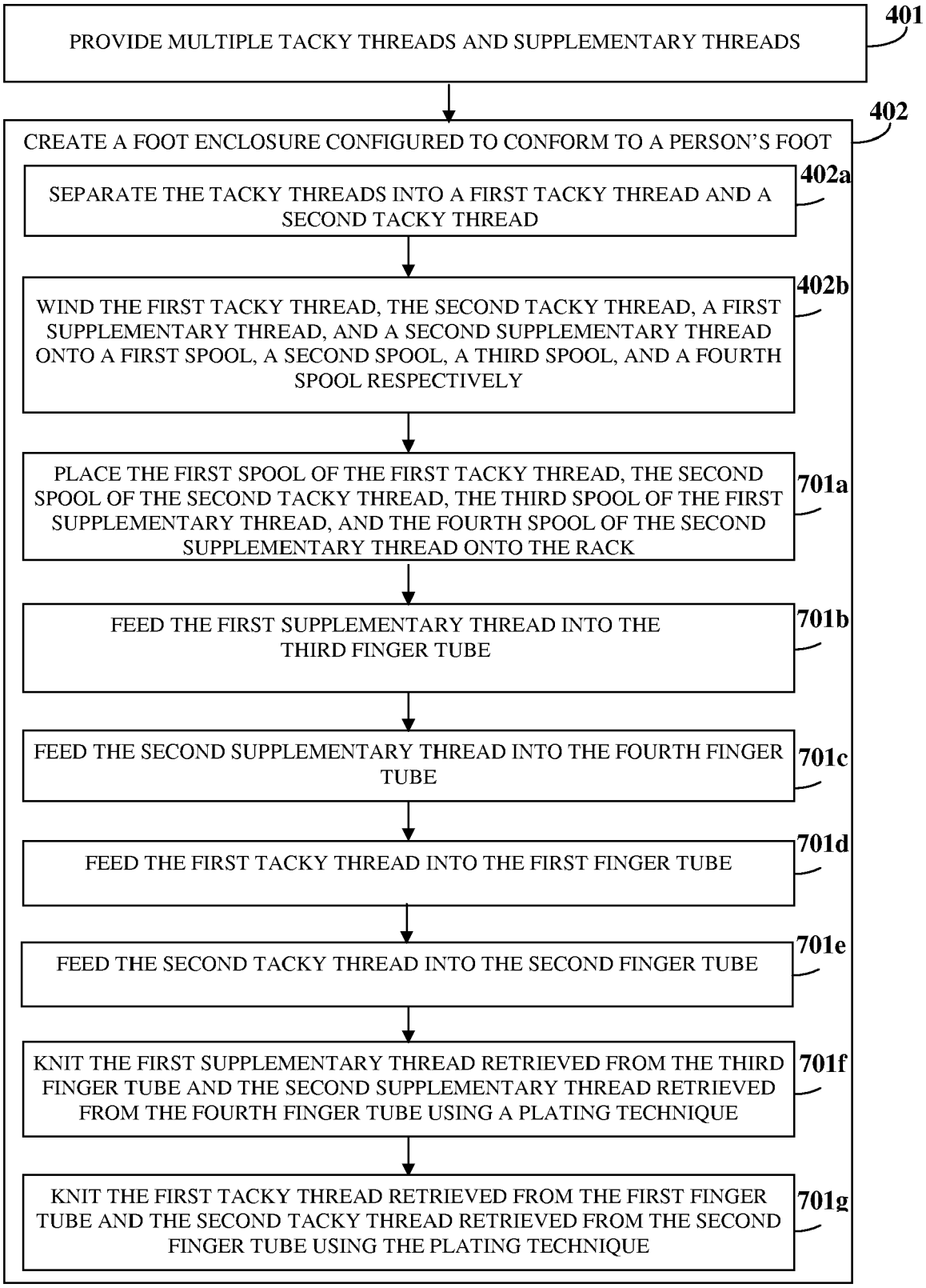
FIG. 7 illustrates an embodiment for constructing a hosiery garment for providing grip to a foot of a person between the foot and the hosiery garment, and for simultaneously providing grip to the foot of the person between the hosiery garment and the inside of a footwear.
Figure 8A:
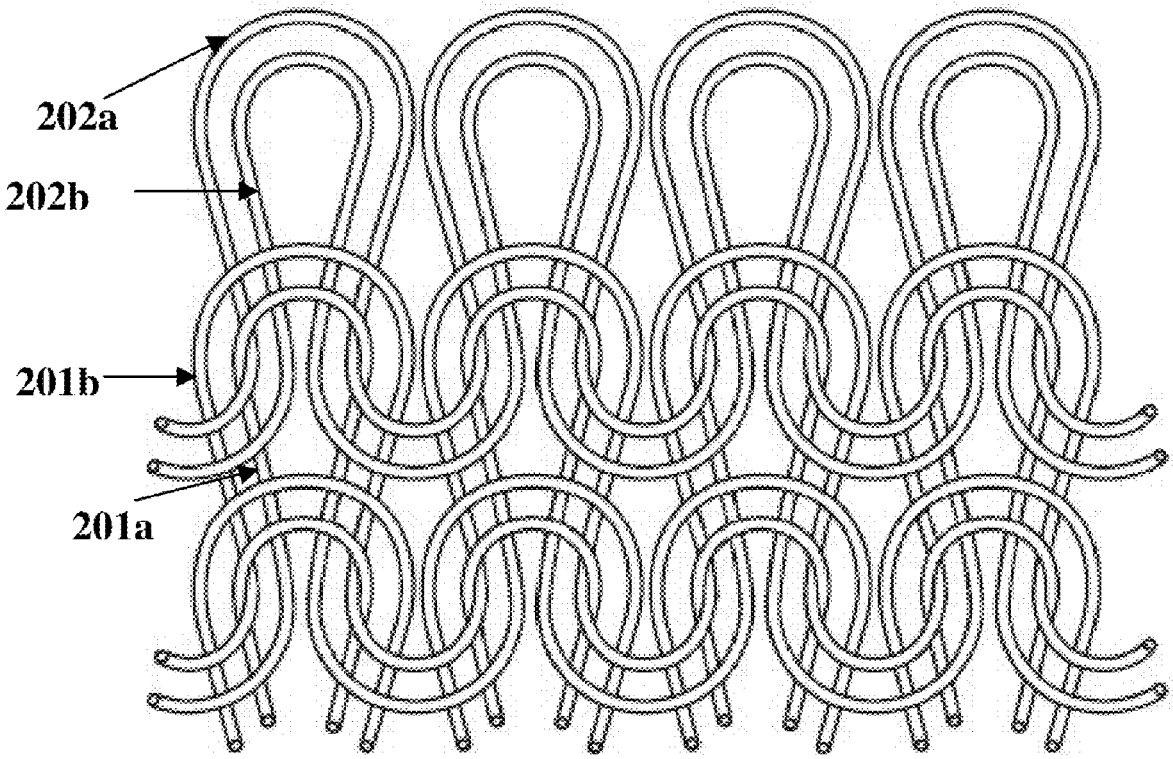
FIG. 8A exemplarily illustrates a rear elevated view of the first pair comprising the first tacky thread and the first supplementary thread knitted with the second pair comprising the second tacky thread and the second supplementary thread.
Figure 8B:
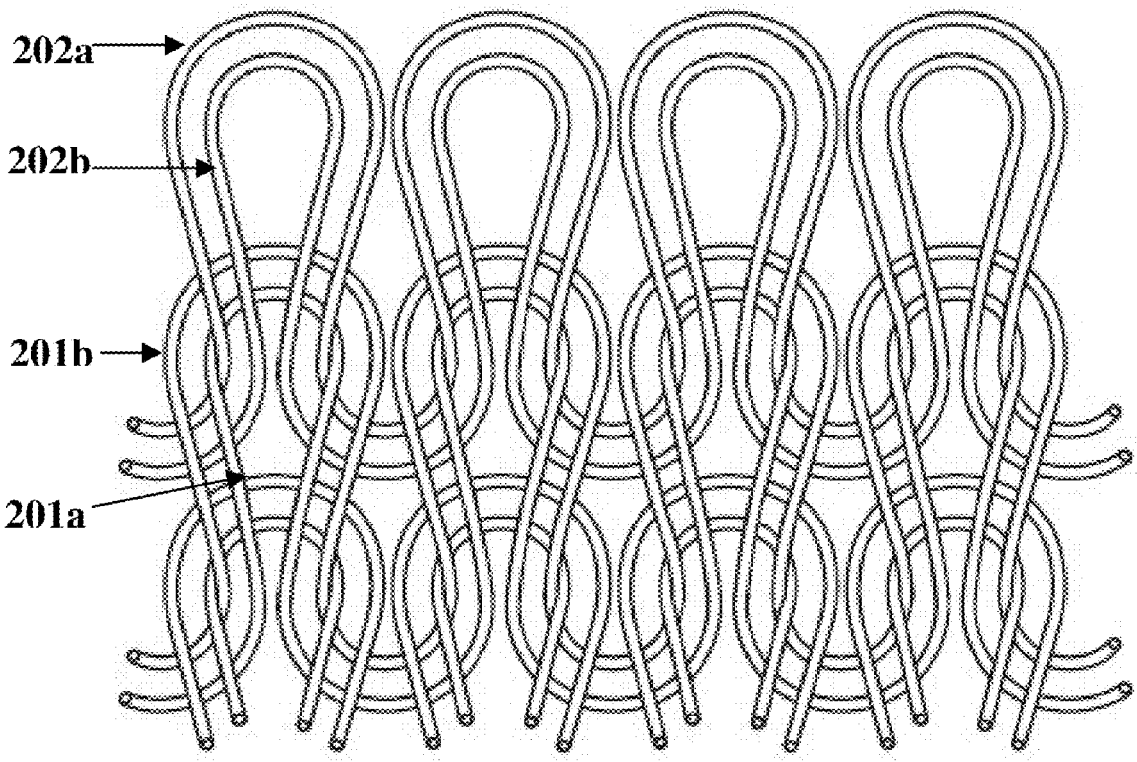
FIG. 8B exemplarily illustrates a top view of the first pair comprising the first tacky thread and the first supplementary thread knitted with the second pair comprising the second tacky thread and the second supplementary thread.
Figure 8C:
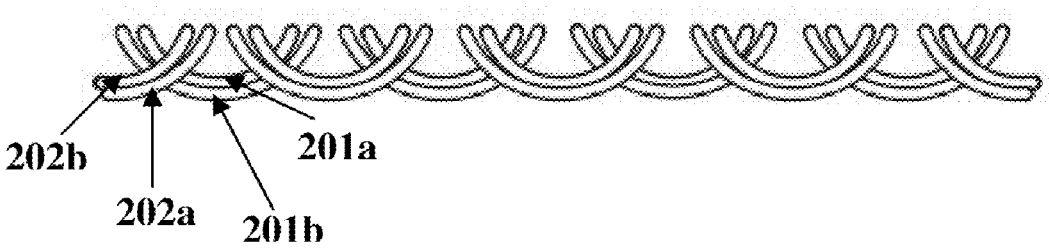
FIGS. 8C-8D exemplarily illustrate side views of first pair comprising the first tacky thread and the first supplementary thread knitted with the second pair comprising the second tacky thread and the second supplementary thread.
Figure 8D:
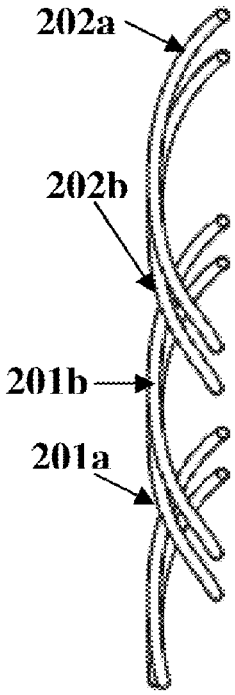

FIG. 7 illustrates an embodiment for constructing a hosiery garment 100 for providing grip to a person's foot between the foot and the hosiery garment 100, and for simultaneously providing grip to the person's foot between the hosiery garment 100 and the inside of a footwear. Consider an example where there are four finger tubes active on the circular knitting machine 603. The first spool 502*a* of the first tacky thread 201*a*, the second spool 502*b* of the second tacky thread 202*a*, the third spool 502*c* of the first supplementary thread 201*b*, and the fourth spool 502*d* of the second supplementary thread 202*b* are placed 701*a* onto the rack 604 as explained in the detailed description of FIG. 4. In this embodiment, the first supplementary thread 201*b* is fed 701*b* into the third finger tube, the second supplementary thread 202*b* is fed 701*c* into the fourth finger tube, the first tacky thread 201*a* is fed 701*d* into the first finger tube, and the second tacky thread 202*a* is fed 701*e* into the second finger tube.

In this method of construction, the latch needles 602 simultaneously retrieve the first supplementary thread 201*b* and the second supplementary thread 202*b* from the third finger tube and the fourth finger tube respectively. The first supplementary thread 201*b* retrieved from the third finger tube and the second supplementary thread 202*b* retrieved from the fourth finger tube is knitted 701*f* using the plating technique, where the first supplementary thread 201*b* goes to the inner surface 101*a* of the foot enclosure 101 and the second supplementary thread 202*b* goes to the outer surface 101*b* of the foot enclosure 101. The first supplementary thread 201*b* is exposed on the inner surface 101*a* of the foot enclosure 101 and the second supplementary thread 202*b* is exposed on the outer surface 101*b* of the foot enclosure 101. After the first course of knitting is complete, the latch needles 602 on the circular knitting machine 603 simultaneously retrieve the first tacky thread 201*a* from the first finger tube and the second tacky thread 202*a* from the second finger tube simultaneously. The first tacky thread 201*a* and the second tacky thread 202*a* are then knitted 701*g* in the plating technique, where the first tacky thread 201*a* goes to the inner surface 101*a* of the foot enclosure 101 and the second tacky thread 202*a* goes to the outer surface 101*b* of the foot enclosure 101. The first tacky thread 201*a* is exposed on the inner surface 101*a*. The first tacky thread 201*a* is not exposed on the outer surface 101*b*. The second tacky thread 202*a* is exposed on the outer surface 101*b*. The second tacky thread 202*a* is not exposed on the inner surface 101*a*. The first pair 201 comprising the first tacky thread 201*a* and the first supplementary thread 201*b* defines the inner surface 101*a* of the foot enclosure 101. The second pair 202 comprising the second tacky thread 202*a* and the second supplementary thread 202*b* defines the outer surface 101*b* of the foot enclosure 101.

The circular knitting machine 603 then continues to alternate on each course of knitting between the tacky threads 201*a* and 202*a* and the supplementary threads 201*b* and 202*b* until the hosiery garment 100 is complete. This technique is also not limited to alternating between the tacky threads 201*a* and 202*a* and supplementary threads 201*b* and 202*b* on each and every course. As an example, the tacky threads 201*a* and 202*a* may be knitted into the hosiery garment 100 on the third course, the fourth course, or any combination thereof.

Consider an example of constructing a hosiery garment 100, for example, a sock that provides grip to a person's foot. Multiple tacky threads 201*a*, 202*a*, etc. for example, made of rubber are coated with an anti-adhesive material, for example, silicon, talcum powder, etc. or both to prevent the threads from gathering and tangling in the machinery.

A foot enclosure 101 configured to conform to the person's foot is then created in the circular knitting machine 603. To create the foot enclosure 101, the tacky threads 201*a*, 202*a*, etc. are separated into two separate spools 502*a* and 502*b* of tacky threads 201*a*, 202*a*, etc. using a twisting machine 501 as exemplarily illustrated in FIG. 5. The spools 502*a* and 502*b* of tacky threads 201*a*, 202*a*, etc. are placed on a rack 604. The rack 604 is positioned on a knitting unit 600 as illustrated in FIG. 6A.

A single tacky thread 201*a* and a single strand of a first supplementary thread 201*b*, for example, cotton, are drawn simultaneously from the spools 502*a* and 502*c* into the first finger tube 601*a* for grouping into the first pair 201. The first pair 201 defines the inner surface 101*a* of the foot enclosure 101. The second tacky thread 202*a* and a single strand of the second supplementary thread 202*b*, for example, nylon, are drawn simultaneously from spools 502*b* and 502*d* into a second finger tube 601*b* for grouping into the second pair 202.

The first pair 201 and the second pair 202 are knitted using a latch needle 602*a* as illustrated in FIG. 6B. The latch needle 602*a* accepts the first pair 201 and the second pair 202 at the same time to form the inner surface 101*a* and the outer surface 101*b* simultaneously, for example, in the knitting pattern known as plating. The inner surface 101*a* formed by the first pair 201 comprising the first tacky thread 201*a* and the first supplementary thread 201*b* and the outer surface 101*b* formed by the second pair 202 comprising the second tacky thread 202*a* and second supplementary thread 202*b* provide grip to the person's foot within the foot enclosure 101 and also between the foot enclosure 101 and the shoe. The first pair 201 may be knitted with the second pair 202 in a twin-threaded pattern as exemplarily illustrated in FIGS. 8A-8D. The rear elevated view, the top view, and the side views of the first pair 201 comprising the first tacky thread 201*a* and the first supplementary thread 201*b* knitted with the second pair 202 comprising the second tacky thread 202*a* and the second supplementary thread 202*b* are exemplarily illustrated in FIG. 8A, FIG. 8B, and FIGS. 8C-8D respectively.

The foregoing examples have been provided merely for the purpose of explanation and are in no way to be construed as limiting of the present invention. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein, rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A hosiery garment for providing grip to a foot of a person between said foot and said hosiery garment, and for simultaneously providing grip to the foot of said person between said hosiery garment and inside of a footwear, comprising:

a foot enclosure, said foot enclosure being configured to conform to the foot of the person, said foot enclosure defining an inner surface and an outer surface, said inner surface being proximal to the foot of the person and distal to said footwear when the person is wearing said foot enclosure and the footwear, said outer surface being distal to the foot of the person and proximal to the footwear when the person is wearing said foot enclosure and the footwear;

a first pair, said first pair comprising a first tacky thread and a first supplementary thread, said first pair defining said inner surface of said foot enclosure, wherein said first tacky thread is exposed on said inner surface of said foot enclosure, and wherein said first tacky thread is not exposed on said outer surface of said foot enclosure; and a second pair, said second pair comprising a second tacky thread and a second supplementary thread, said second pair defining said outer surface of said foot enclosure, wherein said second tacky thread is exposed on said outer surface of said foot enclosure, and wherein said second tacky thread is not exposed on said inner surface of said foot enclosure, and wherein said second pair is knitted with said first pair to define said foot enclosure;

whereby said inner surface of the foot enclosure defined by said first pair provides grip to the foot of the person between said foot and said hosiery garment, and said outer surface of the foot enclosure defined by said second pair simultaneously provides grip to the foot of the person between the hosiery garment and said inside of the footwear.

2. The hosiery garment of claim 1, wherein said first tacky thread and said second tacky thread are made from tacky materials comprising synthetic rubber and natural latex.

3. The hosiery garment of claim 1, wherein the first supplementary thread and the second supplementary thread are selected from materials comprising cotton, nylon, Lycra, and wool.

4. A method of constructing a hosiery garment for providing grip to a foot of a person between said foot and said hosiery garment, and for simultaneously providing grip to the foot of said person between said hosiery garment and inside of a footwear, comprising the steps of:

providing a plurality of tacky threads and supplementary threads;

creating a foot enclosure configured to conform to said foot of said person, said foot enclosure comprising an inner and an outer surface, wherein said step of creating said foot enclosure comprises the steps of:

separating said tacky threads into a first tacky thread and a second tacky thread;

winding said first tacky thread, said second tacky thread, a first supplementary thread, and a second supplementary thread onto a first spool, a second spool, a third spool, and a fourth spool respectively;

grouping said first tacky thread and said first supplementary thread into a first pair;

grouping said second tacky thread and said second supplementary thread into a second pair; and knitting said first pair with said second pair to form said foot enclosure, said first pair defining said inner surface of said foot enclosure, said second pair defining said outer surface of said foot enclosure, said first tacky thread of said first pair is exposed on said inner surface, and wherein said first tacky thread of said first pair is not exposed on said outer surface, said second tacky thread of said second pair is exposed on said outer surface, and wherein said second tacky thread of said second pair is not exposed on said inner surface;

whereby said inner surface defined by said first pair provides grip to the foot of the person between said foot and said hosiery garment, and said outer surface defined by said second pair simultaneously provides grip to the foot of the person between the hosiery garment and said inside of the footwear.

5. The method of claim 4, further comprising the step of placing said first spool of the first tacky thread, said second spool of the second tacky thread, said third spool of the first supplementary thread, and said fourth spool of the second supplementary thread on a rack positioned on a knitting unit prior to creation of the inner surface and the outer surface.

6. The method of claim 4, further comprising the step of feeding the first tacky thread and the first supplementary thread from said first spool and said third spool respectively into a first finger tube.

7. The method of claim 4, further comprising the step of feeding the second tacky thread and the second supplementary thread from said second spool and said fourth spool respectively into a second finger tube.

8. The method of claim 4, wherein the inner surface and the outer surface are created by performing the steps of:

feeding the first tacky thread, the second tacky thread, the first supplementary thread, and the second supplementary thread into a first finger tube, a second finger tube, a third finger tube, and a fourth finger tube respectively;

knitting the first supplementary thread retrieved from said third finger tube and the second supplementary thread retrieved from said fourth finger tube using a plating technique, wherein the first supplementary thread is exposed on the inner surface and the second supplementary thread is exposed on the outer surface; and knitting the first tacky thread retrieved from said first finger tube and the second tacky thread retrieved from said second finger tube using a plating technique, wherein the first tacky thread is exposed on the inner surface and the second tacky thread is exposed on the outer surface, wherein a first pair of the first tacky thread and the first supplementary thread define the inner surface, and a second pair of the second tacky thread and the second supplementary thread define the outer surface.

9. The method of claim 4, wherein the tacky threads are coated with one of silicon and talcum powder.

* * * * *